US008875886B2

(12) United States Patent
Brill et al.

(10) Patent No.: US 8,875,886 B2
(45) Date of Patent: Nov. 4, 2014

(54) CARRIER CARD ARRANGEMENT WITH REMOVABLE ENVELOPE

(75) Inventors: Judith Brill, San Francisco, CA (US); Philip J. Luongo, Jr., San Francisco, CA (US); Ian S. Macnider, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 154 days.

(21) Appl. No.: 12/197,975

(22) Filed: Aug. 25, 2008

(65) Prior Publication Data

US 2010/0044419 A1 Feb. 25, 2010

(51) Int. Cl.
*B65D 73/00* (2006.01)

(52) U.S. Cl.
CPC ..... *B65D 73/0078* (2013.01); *B65D 73/0028* (2013.01)
USPC ..... 206/468; 206/461; 40/124.06

(58) Field of Classification Search
USPC ..... 206/232, 461, 469, 467, 464, 468, 495, 206/806; 229/72, 92.8; 40/124.06; 235/380
See application file for complete search history.

(56) References Cited

U.S. PATENT DOCUMENTS

| | | | | | |
|---|---|---|---|---|---|
| 846,064 | A | * | 3/1907 | Souder | 229/92.3 |
| 1,011,697 | A | * | 12/1911 | Witkowski | 206/462 |
| 2,681,175 | A | * | 6/1954 | David | 229/75 |
| 2,708,068 | A | * | 5/1955 | Guttman | 229/92.8 |
| 3,278,015 | A | * | 10/1966 | Bernstein | 206/578 |
| 3,346,294 | A | | 10/1967 | Sartz | |
| 3,467,299 | A | * | 9/1969 | Meyer | 229/70 |
| 3,527,346 | A | * | 9/1970 | Chalpin | 206/461 |
| 3,908,892 | A | * | 9/1975 | Pelzer | 229/305 |
| 4,319,684 | A | | 3/1982 | Backman et al. | |
| 4,360,106 | A | * | 11/1982 | Irvine et al. | 229/212 |
| 4,828,105 | A | | 5/1989 | Silengo et al. | |
| 5,036,645 | A | | 8/1991 | Schwarz | |
| 5,135,157 | A | | 8/1992 | Cruz | |
| 5,139,454 | A | | 8/1992 | Earnest | |
| 5,143,279 | A | | 9/1992 | Gaines | |
| 5,219,184 | A | | 6/1993 | Wolf | |

(Continued)

FOREIGN PATENT DOCUMENTS

| | | |
|---|---|---|
| EP | 0725376 | 8/1996 |
| EP | 0927945 | 7/1999 |

(Continued)

OTHER PUBLICATIONS

"List." Dictionary of Publishing and Printing. London: A&C Black, 2006, www.credoreference.com/entry/acbpublishing/list, p. 1.

(Continued)

*Primary Examiner* — David Fidei

(57) ABSTRACT

Methods and apparatus for providing a carrier card on which a transaction card is mounted and to which an envelope is integrally but detachably attached are described. According to one aspect, a carrier card arrangement that is suitable for carrying a transaction card includes a carrier portion and an envelope portion that is integrally formed with an edge of the carrier portion. The edge of the carrier portion is at least partially defined by at least one perforation. The carrier portion includes a first surface that is on an opposite side of the carrier portion from a second surface. The envelope portion has a third surface that at least partially abuts the second surface, and is sized to accommodate the transaction card.

23 Claims, 9 Drawing Sheets

(56) References Cited

U.S. PATENT DOCUMENTS 5,263,586 A * 11/1993 Keable ..... 206/469
D344,757 S 3/1994 Kruyt
5,467,917 A * 11/1995 Potter ..... 229/301
5,516,033 A 5/1996 Bernetich
5,573,117 A 11/1996 Adams
5,575,384 A 11/1996 Saye
5,626,551 A 5/1997 Kearns et al.
5,641,115 A 6/1997 Brewster
5,645,214 A 7/1997 Taganas
5,650,209 A * 7/1997 Ramsburg et al. ..... 428/43
5,687,992 A 11/1997 Finkelshteyn
5,755,375 A * 5/1998 Rogers ..... 229/70
5,760,381 A * 6/1998 Stich et al. ..... 235/380
5,791,474 A 8/1998 Hansen
D400,919 S 11/1998 Pickel
5,842,629 A * 12/1998 Sprague et al. ..... 229/71
5,845,425 A 12/1998 Leake et al.
5,862,979 A 1/1999 Hill et al.
5,906,063 A 5/1999 Magee, Sr.
5,918,909 A 7/1999 Fiala et al.
5,941,573 A 8/1999 Yordinsky
5,946,834 A 9/1999 Bradley
5,947,283 A 9/1999 Marshall
5,963,915 A 10/1999 Kirsch
5,963,916 A 10/1999 Kaplan
5,981,040 A 11/1999 Rich et al.
5,984,091 A 11/1999 Orr et al.
6,003,254 A 12/1999 Lorber
6,024,277 A * 2/2000 Martin ..... 229/71
6,050,415 A 4/2000 Lind et al.
6,053,321 A 4/2000 Kayser
6,070,719 A 6/2000 Pollock
6,092,841 A 7/2000 Best et al.
6,199,912 B1 3/2001 Finkelshteyn
6,224,108 B1 5/2001 Klure
6,227,443 B1 * 5/2001 Minato ..... 229/305
6,233,682 B1 5/2001 Fritsch
6,244,444 B1 6/2001 Jacobus et al.
D447,055 S 8/2001 Several et al.
6,270,012 B1 8/2001 Dawson
6,299,530 B1 10/2001 Hansted et al.
6,349,829 B1 * 2/2002 Matheis et al. ..... 206/449
D457,555 S 5/2002 Stephens-D'Angelo et al.
6,385,596 B1 5/2002 Ansell et al.
6,418,648 B1 7/2002 Hollingsworth et al.
6,457,638 B1 10/2002 Schmidt
6,491,213 B2 12/2002 Purcell
6,588,596 B1 7/2003 Holmes et al.
6,619,480 B2 9/2003 Smith
6,659,271 B2 12/2003 Parsons
6,698,116 B2 3/2004 Waldron
6,731,312 B2 5/2004 Robbin
6,957,737 B1 10/2005 Frederickson et al.
D512,456 S 12/2005 Diaz et al.
7,055,740 B1 6/2006 Schultz et al.
7,204,048 B2 * 4/2007 Kershner et al. ..... 40/124.06
D541,647 S * 5/2007 Ashby et al. ..... D9/415
7,219,829 B2 * 5/2007 Treat ..... 229/92.8
7,243,839 B2 * 7/2007 Beck et al. ..... 235/380
D548,279 S 8/2007 Gulakos
7,277,870 B2 10/2007 Mourad et al.
7,278,584 B1 10/2007 Gandel et al.
7,322,519 B2 1/2008 Blank et al.
7,367,504 B2 5/2008 Lewis et al.
7,374,095 B2 * 5/2008 Blank et al. ..... 235/486
7,409,788 B2 8/2008 Lauer et al.
7,490,720 B2 2/2009 Cole et al.
7,500,604 B2 3/2009 Holme
7,546,288 B2 6/2009 Springer et al.
7,584,887 B1 * 9/2009 Sanchez et al. ..... 235/380
7,607,574 B2 * 10/2009 Kingsborough et al. ..... 235/380
7,712,741 B2 5/2010 Lambert
7,740,170 B2 6/2010 Singh et al.
7,822,640 B2 10/2010 Arthur et al.
7,837,125 B2 11/2010 Biskupski et al.
7,896,252 B2 * 3/2011 Narlinger et al. ..... 235/493
8,256,682 B2 * 9/2012 Chakiris et al. ..... 235/486
2001/0034703 A1 10/2001 Picciallo et al.
2001/0040115 A1 11/2001 Wani et al.
2001/0045738 A1 * 11/2001 Klure ..... 283/61
2002/0002468 A1 1/2002 Geisler et al.
2002/0028321 A1 3/2002 Feilen et al.
2002/0080714 A1 6/2002 Pierson et al.
2002/0088855 A1 7/2002 Hodes
2002/0100797 A1 * 8/2002 Hollingsworth et al. .... 229/92.8
2002/0147683 A1 10/2002 Capobianco et al.
2002/0157974 A1 10/2002 Krahn
2002/0195816 A1 12/2002 Anise
2003/0004889 A1 1/2003 Fiala et al.
2003/0018586 A1 1/2003 Krahn
2003/0028439 A1 * 2/2003 Cox et al. ..... 705/26
2003/0066777 A1 * 4/2003 Malone ..... 206/449
2003/0150142 A1 8/2003 Street
2003/0156686 A1 8/2003 Pines
2003/0230501 A1 12/2003 Smolev
2004/0064374 A1 4/2004 Cho
2004/0069660 A1 * 4/2004 Lacomis ..... 206/232
2004/0140361 A1 7/2004 Paul et al.
2004/0140616 A1 7/2004 Davis
2004/0254836 A1 12/2004 Barabas et al.
2004/0267622 A1 12/2004 Taylor et al.
2004/0268386 A1 12/2004 Logan et al.
2005/0017502 A1 * 1/2005 Chariker ..... 283/106
2005/0100312 A1 5/2005 Commons et al.
2005/0167301 A1 8/2005 Oram
2005/0167910 A1 8/2005 Candler
2005/0171795 A1 8/2005 Kearby et al.
2005/0182675 A1 8/2005 Huettner
2005/0279825 A1 * 12/2005 Ashby et al. ..... 235/380
2006/0032764 A1 2/2006 Swenson
2006/0042986 A1 3/2006 Simkowski
2006/0065748 A1 3/2006 Halbur et al.
2006/0086630 A1 4/2006 Cheong et al.
2006/0118618 A1 6/2006 Schultz et al.
2006/0185201 A1 8/2006 Fachon et al.
2006/0212401 A1 9/2006 Ameerally et al.
2006/0224516 A1 10/2006 Lemon et al.
2006/0231609 A1 * 10/2006 Lazarowicz et al. ..... 235/380
2006/0235864 A1 10/2006 Hotelling et al.
2006/0243609 A1 11/2006 Cole et al.
2006/0259189 A1 11/2006 Perlow et al.
2006/0261154 A1 11/2006 Arthur et al.
2007/0017973 A1 * 1/2007 Blank et al. ..... 235/380
2007/0038577 A1 2/2007 Werner et al.
2007/0063052 A1 3/2007 Chakiris et al.
2007/0090184 A1 4/2007 Lockwood et al.
2007/0154167 A1 7/2007 Ando et al.
2007/0174200 A1 7/2007 Sung-Min et al.
2007/0182155 A1 * 8/2007 Duffy ..... 283/116
2007/0187492 A1 8/2007 Graves et al.
2007/0198418 A1 8/2007 Macdonald et al.
2007/0208664 A1 9/2007 Ortega
2007/0224969 A1 9/2007 Rao
2007/0267502 A1 11/2007 Zellner et al.
2007/0278280 A1 12/2007 Wert et al.
2007/0289890 A1 12/2007 Appelbaum
2008/0052371 A1 2/2008 Partovi et al.
2008/0116088 A1 5/2008 Roberts
2008/0116089 A1 5/2008 Roberts
2008/0120609 A1 5/2008 Gates et al.
2008/0154722 A1 6/2008 Galinos
2008/0159715 A1 7/2008 Fuasaro et al.
2008/0188209 A1 8/2008 Dorogusker et al.
2008/0190267 A1 8/2008 Rechstein et al.
2008/0320139 A1 12/2008 Fukuda et al.
2009/0063292 A1 3/2009 Cole et al.
2009/0104539 A1 4/2009 Watanabe et al.
2009/0107862 A1 * 4/2009 Pascua et al. ..... 206/232
2009/0199516 A1 * 8/2009 Gustavsson ..... 53/467
2009/0218392 A1 9/2009 Biskupski et al.
2009/0283594 A1 11/2009 Walton et al.
2010/0219099 A1 9/2010 Schmitt et al.
2010/0253063 A1 10/2010 Skogster
2011/0137793 A1 * 6/2011 Liggett ..... 705/41

(56) References Cited

U.S. PATENT DOCUMENTS

| | | | |
|---|---|---|---|
| 2012/0025516 | A1 | 2/2012 | Miller et al. |
| 2012/0234909 | A1 | 9/2012 | Tang |
| 2012/0259718 | A1 | 10/2012 | Miller et al. |

FOREIGN PATENT DOCUMENTS

| | | | |
|---|---|---|---|
| EP | 1111562 | | 6/2001 |
| FR | 2827981 | | 1/2003 |
| WO | WO99/24942 | A | 5/1999 |
| WO | WO00/28461 | | 5/2000 |
| WO | WO00/43852 | | 7/2000 |
| WO | WO00/62265 | | 10/2000 |
| WO | WO01/41023 | | 6/2001 |
| WO | WO01/44908 | | 6/2001 |
| WO | WO01/46786 | | 6/2001 |
| WO | WO01/50305 | | 7/2001 |
| WO | WO02/08869 | | 1/2002 |
| WO | WO03/007233 | | 1/2003 |
| WO | 2004/038567 | A | 5/2004 |
| WO | 2004/044770 | A | 5/2004 |

OTHER PUBLICATIONS

"Listing." Collins English Dictionary. London: Collins, 2000, www.credoreference.com/entry/hcengdict/listing, p. 1.

"Bin." Collins English Dictonary, London: Collins, 2000, www.credoreference.com/entry/hcengdict/bin, p. 1.

"Rack 1",Collins English Dictonary, London, Collins 2000, www.credoreference.com/entry/hcengdict.rack_1, 1 pg.

"Price", Chambers 21st Centruy Dictonary, London, Chambers Harrap, 2001, www.credoreference.com/entry/chambdict/price, 1 pg.

"Allow", Webster's Third New International Dictionary, Merriam-Webster, downloaded Jul. 14, 2009, http://lionreference.chadwyck.com/searchFulltextdo?id=871261&idType=offset&divLevel=2&queryId=../sessions/1247680262_19043&area=mwd&forward=refshelf&trail=refshelf, 2 pg.

"Value", Webster's Third New International disconary, Merriam-Webster, Incorporated, downloaded Jul. 15, 2009, http://lionreference.chadwyck.com/searchFulltext.do?id=38664807&idTyple=offset&divLevel=2&queryID=../session/1247683362_2487&area=mwd&forward=refshelf&trail=refshelf, p. 4.

"Media", Chambers 21st Century Dictionary, London, Chambers Harrap, 2001, downloaded Jul. 15, 2009, www.credoreference.com/entry/chambdict/media.com, 1 pg.

"Associate", Collins English Dictionary, London, Collins 2000, www.credoreference.com/entry/hcengdict/associate, 1 pg.

"Active", Webster's Third New International Dictionary, Merriam-Webster, Inc., downloaded Jul. 16, 2009, http://lionreference.chadwyck.com/searchFulltext.do?id=313560&idType=offset&divLevel=2&queryID=../session/1247778592_27918&area=mwd&forward=refshelf&trail=refshelf, 3 pg.

"Activate", Webster's Third New International Dictionary, Merriam-Webster, Inc., downloaded Jul. 16, 2009, http://lionreference.chadwyck.com/searchFulltext.do?id=312239&idType=offset&divLevel=2&queryID=../session/1247778879_29216&area=mwd&forward=refshelf&trail=refshelf, 2 pg.

The Bank Credit Card Business, 2nd Edition, American Bankers Association, Washington D.C., 1996, pp. 1-13, 63-89.

Smart Card Handbook, 2nd Edition, W. Rankl and W. Effing, John Wiely and Sons, West Sussex, England, 2000, pp. 1-25.

"Identification Cards—Recording Technique—Part 7: Magnetic Strip—High Coercivity, High Density", ISO Standard, ISO/IEC 7811-7:2004 downloaded Dec. 26, 2007, 2 pgs.

"American National Standard Specifications for Credit Cards", American National Standards Institute, Inc. (ANSI), x4.13/1971, 1971, 18 pgs.

"American National Standard Magnetic-Stripe Encoding for Credit cards", American National Standards Institute, Inc. (ANSI), x4.16/1976, 1976, 12 pgs.

Offenberg, J. "Markets—Gift Cards", Journal of Economic Perspectives, vol., 21, No. 2, Spring 2007, pp. 227-238.

"Identification Cards-Recording Technique", International Standard ISO/IEC, vol. 7811-2, No. Third Edition, Feb. 1, 2001, pp. 1-21.

Pottery Barn, Gift Cards, Web Page, downloaded Jun. 27, 2008, 1 pg.

* cited by examiner

CARRIER CARD ARRANGEMENT WITH REMOVABLE ENVELOPE

BACKGROUND OF THE INVENTION

1. Field of the Invention

The present invention relates to transaction cards and, more particularly, to providing a transaction card on a carrier card which includes a removable envelope into which the transaction card may be placed.

2. Description of the Related Art

Monetary transaction cards such as pre-paid cards, e.g., gift cards, are often attached to card carriers which enable the pre-paid cards to be displayed. The pre-paid cards are typically attached to a front surface of a card carrier. The card carriers may include openings which enable the card carriers and, hence, the pre-paid cards to be displayed on a pegged display rack at a retail establishment.

People often give monetary transaction cards as gifts. That is, a person may purchase a monetary transaction card to present to another person to as a gift. When a person presents a monetary transaction card as a gift, he or she may present the monetary transaction card mounted on a card carrier.

Gifting a monetary transaction card mounted on a card carrier may be considered to be inelegant by some. Those who consider presenting a recipient with a transaction card mounted on a card carrier to be inelegant may remove the transaction card from the card carrier, and place the transaction card in a gift box or in a greeting card. However, obtaining a gift box or a greeting card may be inconvenient. That is, effectively wrapping a transaction card may be inconvenient.

Some monetary transaction cards are sold in packages which are ready for gifting. Such packages, in general, are formed as greeting cards or folders in which monetary transaction cards are secured inside. In such packages, the monetary transaction cards are not visible until flaps on the greeting cards or folders are opened. While such packages facilitate the giving of monetary transaction cards as gifts, they make it difficult for a purchaser to see what he or she is purchasing, as the monetary transaction cards are obscured within the packages.

Therefore, what is desired is a method and an apparatus which allows for a transaction card which is mounted on a surface of a card carrier to be readily presented as a gift. That is, what is needed is an arrangement which enables a gift giver to efficiently obtain and wrap a transaction card such that the transaction card may be presented as a gift, while the arrangement maintains a substantially standard footprint as a standard card carrier.

SUMMARY OF THE INVENTION

The present invention pertains to carrier cards, including carrier cards with detachable envelopes as well as methods for forming such carrier cards. The present invention may be implemented in numerous ways, including, but not limited to, as a method, system, device, or apparatus. Example embodiments of the present invention are discussed below.

According to one aspect of the present invention, a carrier card arrangement that is suitable for carrying a transaction card includes a carrier portion and an envelope portion that is integrally formed with an edge of the carrier portion. The edge of the carrier portion is at least partially defined by at least one perforation. The carrier portion includes a first surface that is on an opposite side of the carrier portion from a second surface. The envelope portion has a third surface that at least partially abuts the second surface, and is sized to accommodate the transaction card.

In one embodiment, the envelope portion is arranged to be detached from the carrier portion at the at least one perforation. In another embodiment, the carrier card arrangement is formed from a single sheet of paper stock.

According to another aspect of the present invention, a card package includes a carrier card arrangement and a transaction card. The carrier card arrangement has a carrier card and an envelope. The carrier card has a front surface. The envelope and the carrier card are integrally formed and share an edge that has at least one perforation. The transaction card is mounted at least partially on the front surface of the carrier card.

In one embodiment, the card package also includes at least one adhesive element that secures the envelope against the back surface. In another embodiment, the transaction card includes an activation element and the carrier card includes a first opening. In such an embodiment, the activation element is accessible through the first opening.

According to still another aspect of the present invention, a method of forming a carrier card arrangement includes obtaining a single sheet of material, defining a carrier card portion on the single sheet of material, and defining an envelope portion on the single sheet of material. The carrier card portion and the envelope portion share a common perforated edge. The method also includes manipulating the single sheet of material to create a carrier from the carrier card portion and an envelope from the envelope portion.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

Example embodiments of the present invention are discussed below with reference to the various figures. However, those skilled in the art will readily appreciate that the detailed description given herein with respect to these figures is for explanatory purposes, as the invention extends beyond these embodiments.

Providing an envelope with a card package that includes a transaction card allows a purchaser of the card package to relatively efficiently "wrap" the transaction card in the envelope such that the transaction card may be presented as a gift. Typically, a card package includes a transaction card and a carrier card assembly which has a carrier card portion and an envelope portion.

A card package that includes a transaction card, e.g., a gift card, a carrier card, and an envelope is arranged such that the transaction card is visible when mounted on the carrier card. The envelope is generally coupled to the carrier card along a perforated edge or border such that the envelope may be readily detached from, or otherwise separated from, the carrier card.

In one embodiment, activation information that enables the transaction card to be activated may be visible when the transaction card is mounted on the carrier card. The activation information may be embodied as an activation element including, but not limited to including, a bar code, a magnetic stripe, and/or an activation code that is accessible when the transaction card is mounted on a carrier card. The accessibility of activation information allows the transaction card to be activated while mounted on the carrier card. Hence, at a point of sale of a card package, a purchaser may purchase a transaction card and an envelope in one package, while a seller may activate the transaction card, e.g., by scanning the activation element of the transaction card, without removing the transaction card from the package.

Figure 1A:
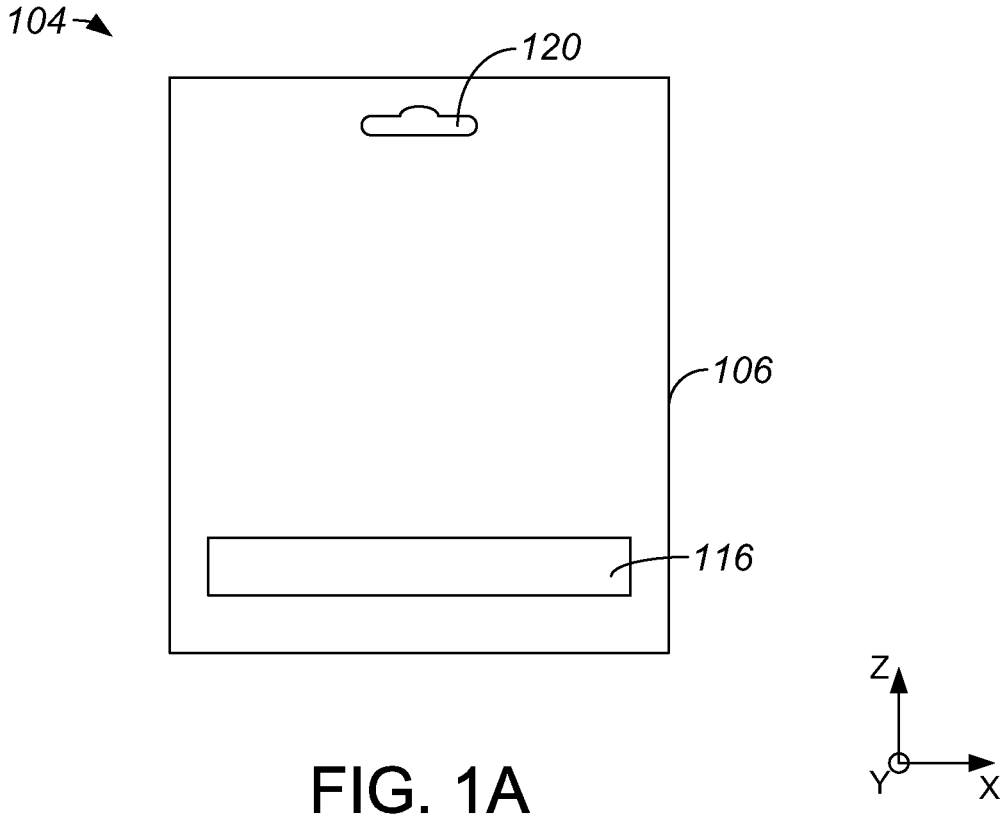
FIG. 1A is diagrammatic front-view representation of a carrier card arrangement in accordance with an embodiment of the present invention.
Figure 1B:
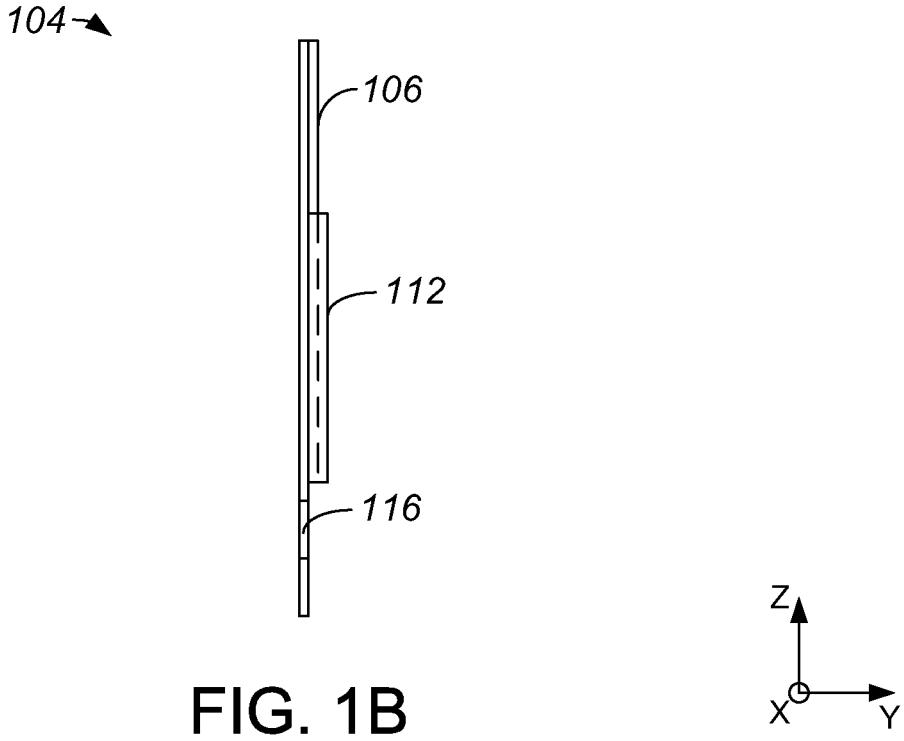
FIG. 1B is diagrammatic side-view representation of a carrier card arrangement, e.g., carrier card arrangement 104 of FIG. 1A, in accordance with an embodiment of the present invention.
Figure 1C:
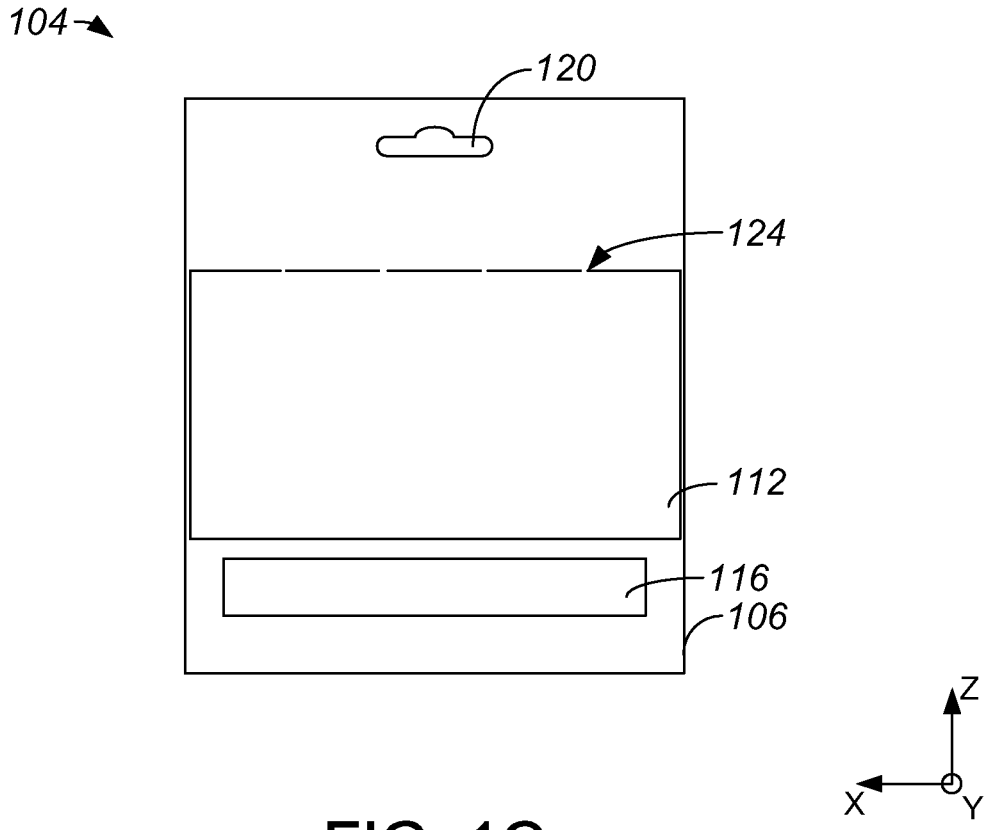
FIG. 1C is diagrammatic back-view representation of a carrier card arrangement, e.g., carrier card arrangement 104 of FIG. 1A, in accordance with an embodiment of the present invention.

Referring initially to FIGS. 1A-C, a carrier card arrangement that includes an envelope will be described in accordance with an embodiment of the present invention. FIG. 1A is diagrammatic representation of a front surface of a carrier card arrangement which includes an envelope. A carrier card arrangement 104 includes a carrier card 106 or a display card in which openings 116, 120 are formed. Opening 116 is positioned such that a bar code, magnetic stripe, and/or activation code of a transaction card (not shown) mounted on the front surface of carrier card 106 may be viewed from the back side of carrier card arrangement 104. Because a bar code, magnetic stripe, and/or activation code of a transaction card (not shown) is visible and, hence, accessible through opening 116, Opening 120, which is optional, is defined within carrier card 106 to enable carrier card arrangement 104 to be hung on dowels or other support apparatus for display purposes, e.g., such that carrier card arrangement 104 may be displayed in a retail establishment. Opening 120 may generally take substantially any suitable shape, such as a "sombrero" shape as shown, a circular shape, or an ovular shape.

An envelope 112, as shown in FIGS. 1B and 1C, is coupled to carrier card 106 and is in contact with a back surface of carrier card 106. Envelope 112 is generally sized to accommodate a transaction card (not shown). By way of example, envelope 112 may be sized to accommodate a standard CR-80 card. The coupling between envelope 112 and carrier card 106 is a perforated edge 124, or a seam that includes perforations. Envelope 112 is coupled to carrier card 106 such that a perforated edge 124 is a long side or edge of envelope 112, and is substantially parallel to a top edge of carrier card 106. Typically, envelope 112 is substantially only integrally, but detachably, coupled to carrier card 106 at perforated edge 124. However, in one embodiment, an amount of adhesive (not shown) may removably secure envelope 112 to the back surface of carrier card 106 to reduce the likelihood that envelope 112 may accidentally be detached from carrier card 106. The amount of adhesive (not shown) may be provided as at least one drop of adhesive, or at least one continuous strip of adhesive.

Perforations in perforated edge 124 are generally relatively long, as shown. Although perforations in perforated edge 124 may generally be of any length, perforations that are relatively long substantially minimize the notches that are typically left on envelope 112 when envelope 112 is detached from carrier card 106. In one embodiment, such notches are effectively hidden by folds of envelope 112. The length of perforations in perforated edge 124 may vary widely. As such, the number of perforations in perforated edge 124 may also vary widely. By way of example, perforated edge 124 may include approximately four or five relatively long perforations.

Figure 2A:
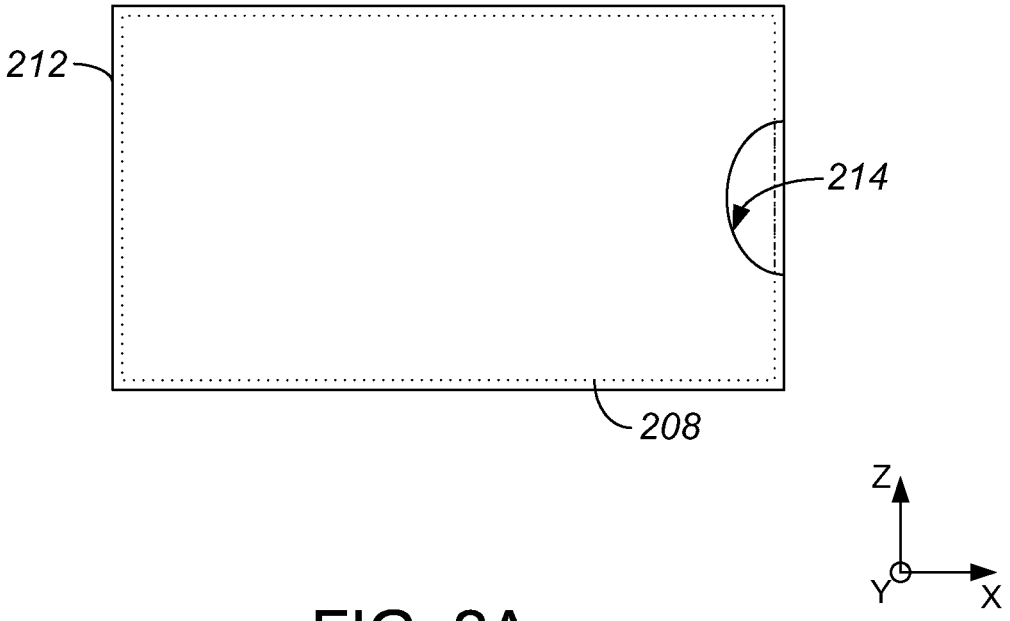
FIG. 2A is a diagrammatic front-view representation of a card envelope in accordance with an embodiment of the present invention.
Figure 2B:
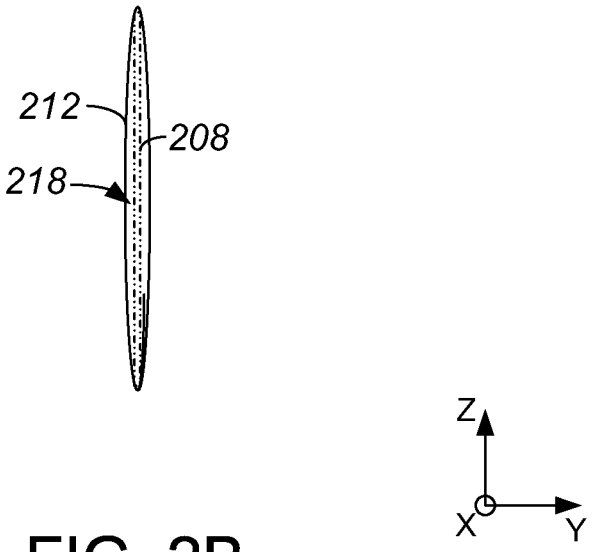
FIG. 2B is a diagrammatic side-view representation of a first side of a card envelope, e.g., card envelope 212 of FIG. 2A, in accordance with an embodiment of the present invention.
Figure 2C:
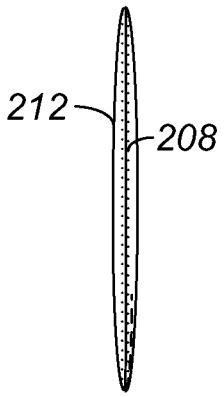
FIG. 2C is a diagrammatic side-view representation of a first side of a card envelope, e.g., card envelope 212 of FIG. 2A, in accordance with an embodiment of the present invention.
Figure 2C:
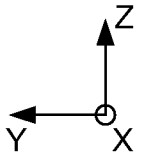

With reference to FIGS. 2A-C, an envelope which is detachable from a carrier card will be described in accordance with an embodiment of the present invention. FIG. 2A is a front-view representation of an envelope, while FIGS. 2B and 2C are side-view representations of the envelope. An envelope 212 includes a notch 214 which enables a transaction card 208 held within envelope 212 to be readily removed. Notch 214 may be a thumbhole that facilitates the removal of transaction card 208 from within envelope 212 when a user's thumb makes contact with transaction card 208 through notch 214 to slide transaction card 208 out of envelope 212.

Transaction card 208 may be inserted into an opening 218 that effectively forms a first side of envelope 212. As shown in FIG. 2B, opening 218 traverses the first side of envelope 212, or the side of envelope 212 substantially at which notch 214 is effectively positioned. Although opening 218 is typically positioned along a short side or edge of envelope 212, opening 218 is not limited to being positioned along the short side of envelope 212. That is, opening 218 may instead be positioned along a long side of envelope.

In general, envelope 212 is formed such that one side includes an opening 218, while other sides are substantially closed. The side substantially opposite from the side with opening 218, as shown in FIG. 2C, is sealed in the described embodiment. It should be appreciated, however, that in other embodiments, the side substantially opposite from the side with opening 218 may include an opening.

Envelope 212 may be decorated, e.g., surfaces of envelope 212 may be printed. In one embodiment, at least one surface of envelope 212 may be printed with the words "To" and "From" such that the names of a giver and a receiver, respectively, may be filled in. Envelope 212 may also be decorated with various messages including, but not limited to including, "Happy Birthday," "Seasons Greetings," "Thank you," "Congratulations," and the like.

Typically, a carrier card arrangement is formed from a single piece of material that is folded and glued together to define a carrier card and an envelope. The material from which a carrier card arrangement is formed may vary widely. By way of example, a carrier card arrangement may be formed from a paper material such as McCoy 120# silk cover paper stock. It should be appreciated, however, the carrier card is not limited to being formed from a paper material.

Figure 3:
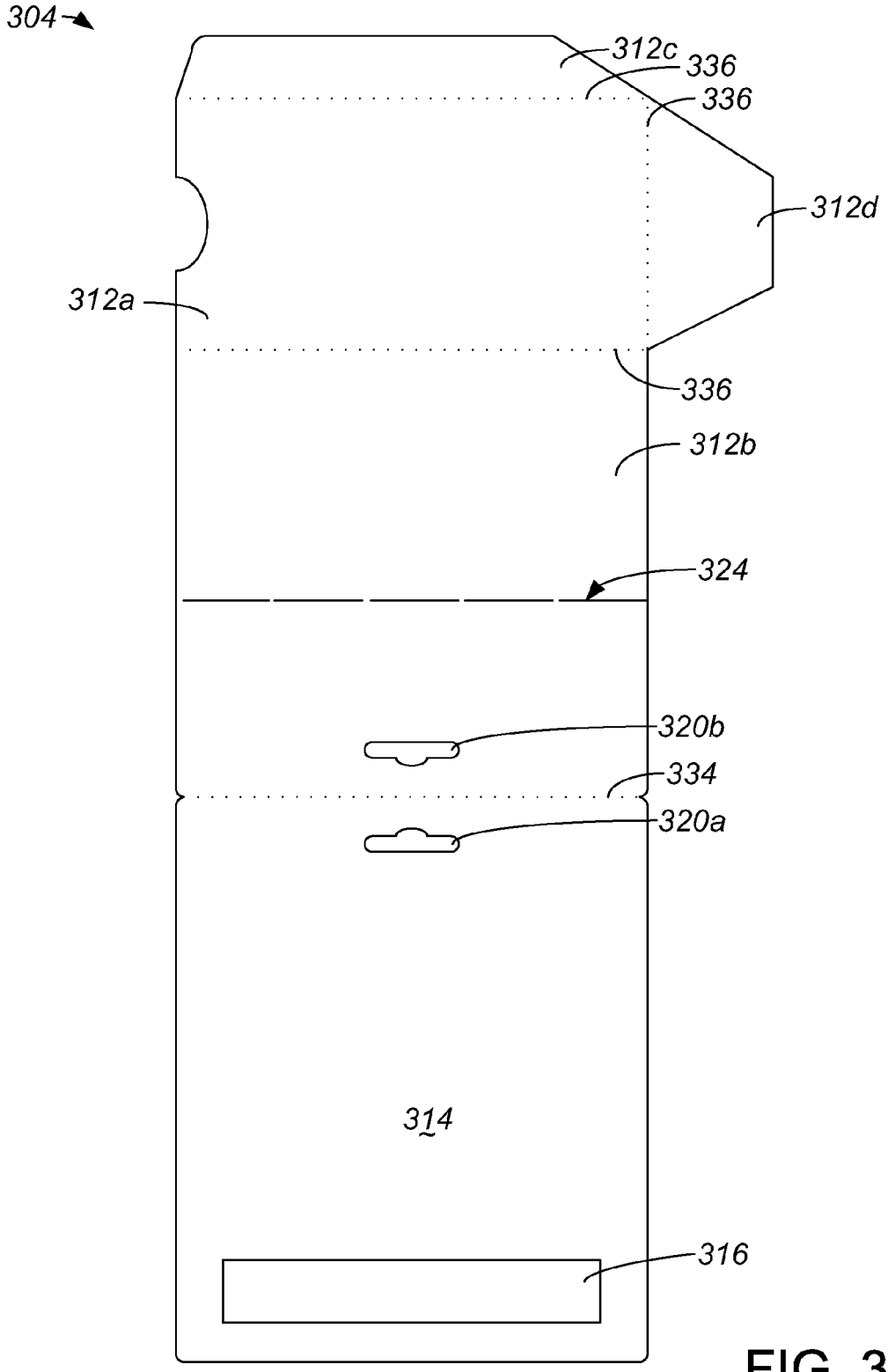
FIG. 3 is a diagrammatic representation of an unfolded carrier card arrangement in accordance with an embodiment of the present invention.

FIG. 3 is a diagrammatic representation of an unfolded carrier card arrangement in accordance with an embodiment of the present invention. An unfolded carrier card arrangement 304 includes an opening 316 that is arranged to enable a portion of a back of a transaction card (not shown) mounted on a front surface 314 of arrangement 304 to be viewed from the back of arrangement 304. Openings 320*a*, 320*b* are arranged such that when arrangement 304 is folded at a fold line 334 or otherwise manipulated, openings 320*a*, 320*b* align to effectively form a single overall opening that enables arrangement 304, when assembled, to be hung on a peg or a dowel. Arrangement 304 may be folded at fold line 334 using a machine such as a press.

Portions 312*a-d* are arranged to form an envelope when arrangement 304 is folded into a carrier card with an attached envelope. Perforations 324, e.g., cuts in arrangement 304, are arranged to delineate a border between portions 312*a-d* which are associated with envelope and a carrier card. In addition, perforations 324 are arranged to allow a formed envelope to be detached from the carrier card.

When the envelope is formed, folds are made along lines 336 which at least partially define portions 312*a-d*. Tabs 312*c*, 312*d* are adhered, e.g., glued, to portion 312*b* to define the envelope when folds are made along lines 336. Though tabs 312*c*, tab 312*d* is typically adhered such that tab 312*d* is effectively inside of a formed envelope, tab 312*d* may instead be adhered such that tab 312*d* is on the outside of a formed envelope.

Figure 4:
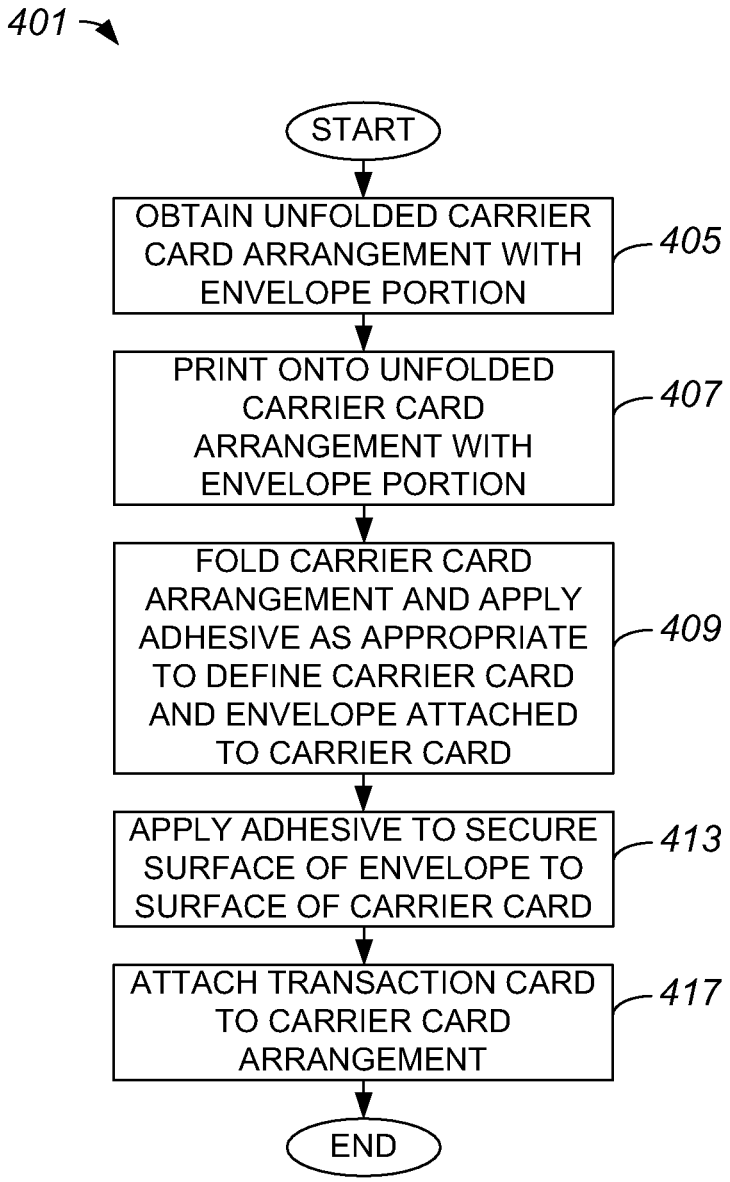
FIG. 4 is a process flow diagram which illustrates one method of forming a carrier card arrangement in accordance with an embodiment of the present invention.

An overall card package may be formed using carrier card arrangement 304 when a transaction card (not shown) is secured to folded carrier card arrangement 304, or a carrier card arrangement 304 that has effectively been assembled such that an envelope and a carrier card are substantially defined. FIG. 4 is a process flow diagram which illustrates one method of forming a card package in accordance with an embodiment of the present invention. A method 401 of forming or creating a card package begins at step 405 in which an unfolded carrier card arrangement is obtained. The carrier card arrangement, e.g., carrier card arrangement 304 of FIG. 3, generally includes an envelope portion.

In step 407, the unfolded carrier card arrangement is printed. Printing the unfolded carrier card arrangement may include printing, or screening, text, graphics, and the like onto surfaces of the carrier card arrangement. By way of example, an envelope portion may be printed with a "To" and a "From" area, a front surface of the carrier card may be printed with an value of a transaction card, and a back surface of the carrier card may be printed with instructions on how to detach the envelope from the carrier card.

The carrier card arrangement is folded, and adhesive is applied as appropriate to the carrier card arrangement, in step 409. The carrier card arrangement is folded such that a carrier card and an envelope are defined. Adhesive may be applied along tabs that are used to create the envelope, e.g., tab 312*c* and tab 312*d* of FIG. 3.

After the carrier card arrangement is folded and the envelope is defined, adhesive is applied in step 413 such that a body of the envelope is effectively secured against the carrier card. The adhesive may be applied to at least one predetermined location on the surface of the carrier card. It should be appreciated that applying adhesive substantially between a surface of the envelope and a surface of the carrier card such that the envelope is substantially secured against the carrier card is optional. By way of example, a surface of the envelope may be in contact with, or essentially rest against, a back of the carrier card without an adhesive holding the surface of the envelope to the back of the carrier card.

The transaction card is attached to the carrier card arrangement in step 417. Typically, the transaction card is attached to a front surface of the carrier card arrangement, or not on the same surface to which the envelope is secured. In one embodiment, adhesive may be used to attach the transaction card to the carrier card arrangement. Once the transaction card is attached to the carrier card arrangement, the method of forming a card package is completed.

Figure 5:
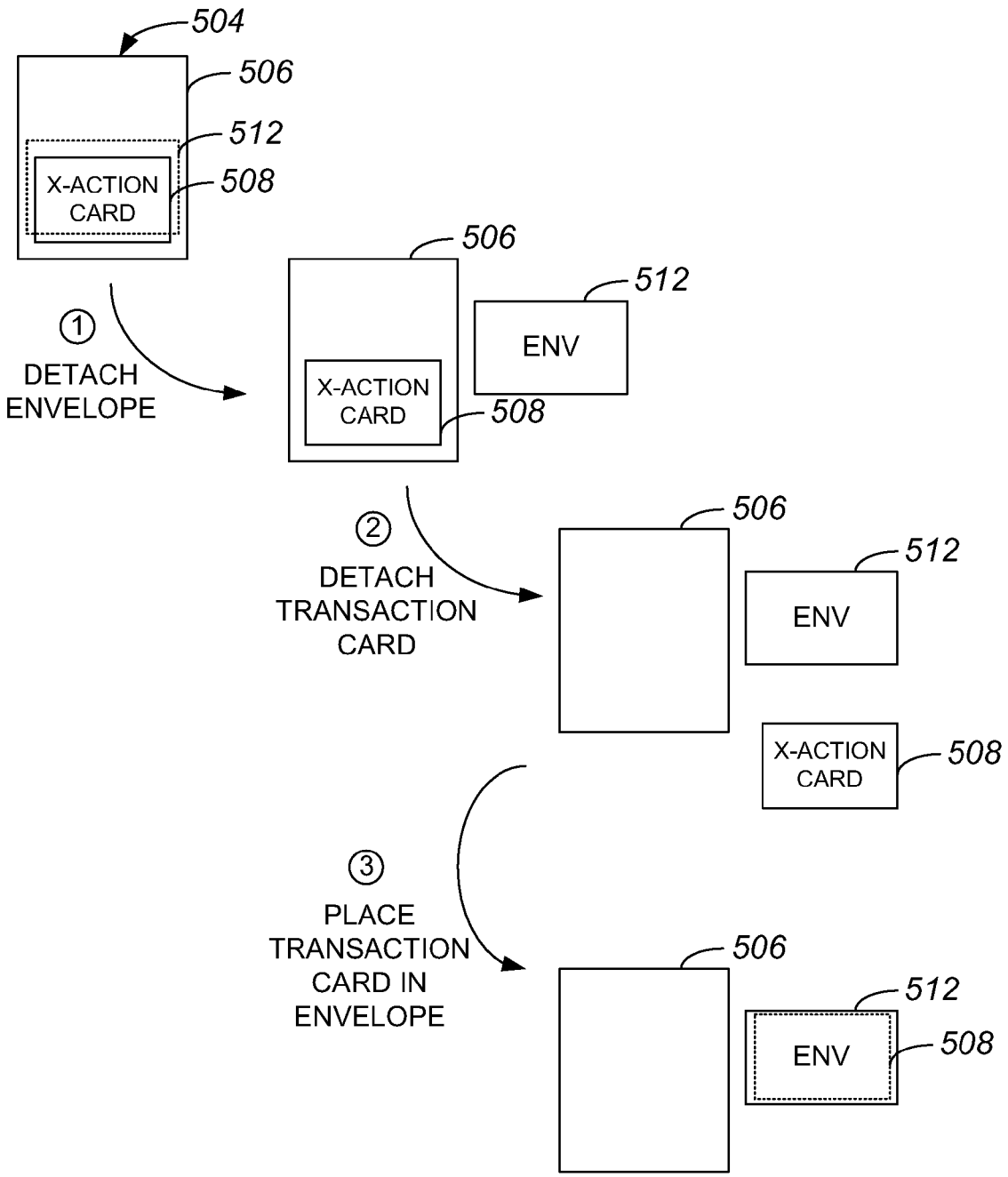
FIG. 5 is a diagrammatic representation of process of using a card package in accordance with an embodiment of the present invention.

A purchaser may purchase or otherwise obtain a card package which includes a transaction card and an envelope. Upon obtaining the card package, the purchaser may elect to detach the transaction card and the envelope, and to place the transaction card in the envelope. FIG. 5 is a diagrammatic representation of process of using a card package in accordance with an embodiment of the present invention. A purchaser or user may obtain a card package that includes a card carrier assembly 504 on which a transaction card 508 is secured. Carrier card assembly 504 includes a carrier card 506 and an envelope 512 that is substantially integrally formed with carrier card 506.

The purchaser may detach envelope 512 from carrier card 506, e.g., by separating envelope 512 from carrier card 506 at a perforated edge (not shown). Instructions which instruct the purchaser on how to separate envelope 512 from carrier card 506 may be printed or otherwise provided on carrier card 506, e.g., on the surface of carrier card 506 that has the perforated edge (not shown). The purchaser may also detach transaction card 508 from carrier card 506. After the purchaser detaches, or otherwise separates, envelope 516 and transaction card 508 from carrier card 506, the purchaser may place transaction card 508 inside envelope 512. By way of example, as mentioned above, if the purchaser wishes to present transaction card 508 to someone as a gift, he or she may wish to place transaction card 508 inside envelope 512 as a way or presenting transaction card 508 as a gift.

Figure 6:
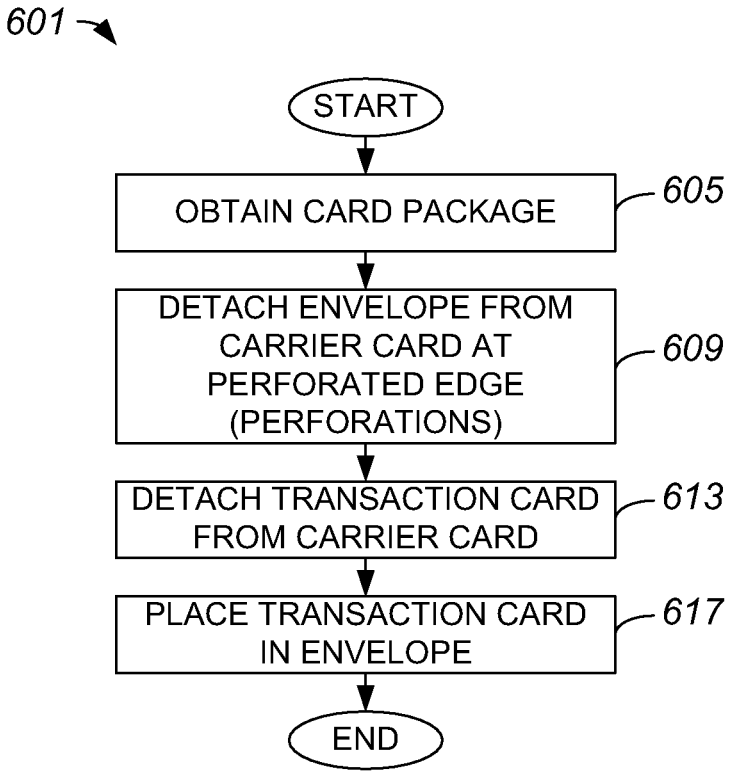
FIG. 6 is a process flow diagram which illustrates a method of using a card package in accordance with an embodiment of the present invention.

FIG. 6 is a process flow diagram which illustrates a method of using a card package, i.e., creating a wrapped gift from components of a card package, in accordance with an embodiment of the present invention. A process 601 of using a card package begins at step 605 in which a card package is obtained. Obtaining the card package, which includes a carrier card with an attached envelope and a transaction card, may include activating the transaction card.

Once the card package is obtained, the envelope is detached from the carrier card in step 609. In general, the envelope is coupled to the carrier card at a perforated edge or seam. As such, detaching the envelope from the carrier card typically includes separating the envelope from the carrier card at the perforated edge. After the envelope is detached from the carrier card, the transaction card is then detached from the carrier card in step 613. It should be appreciated that although the envelope is described as being detached before the transaction card, the transaction card may instead be detached before the envelope. In one embodiment, instructions on how to detach the envelope from the carrier card may be printed on, or otherwise provided on, the carrier card.

When both the envelope and the transaction card are effectively separated from the carrier card, the transaction card is placed in the envelope in step 617. Placing the transaction card in the envelope may include sliding the transaction card into the envelope through an opening in the envelope. After the transaction card is placed in the envelope, the transaction card is effectively wrapped and, hence, ready to be presented as a gift. The process of using a card package is completed once the transaction card is placed in the envelope.

Figure 7:
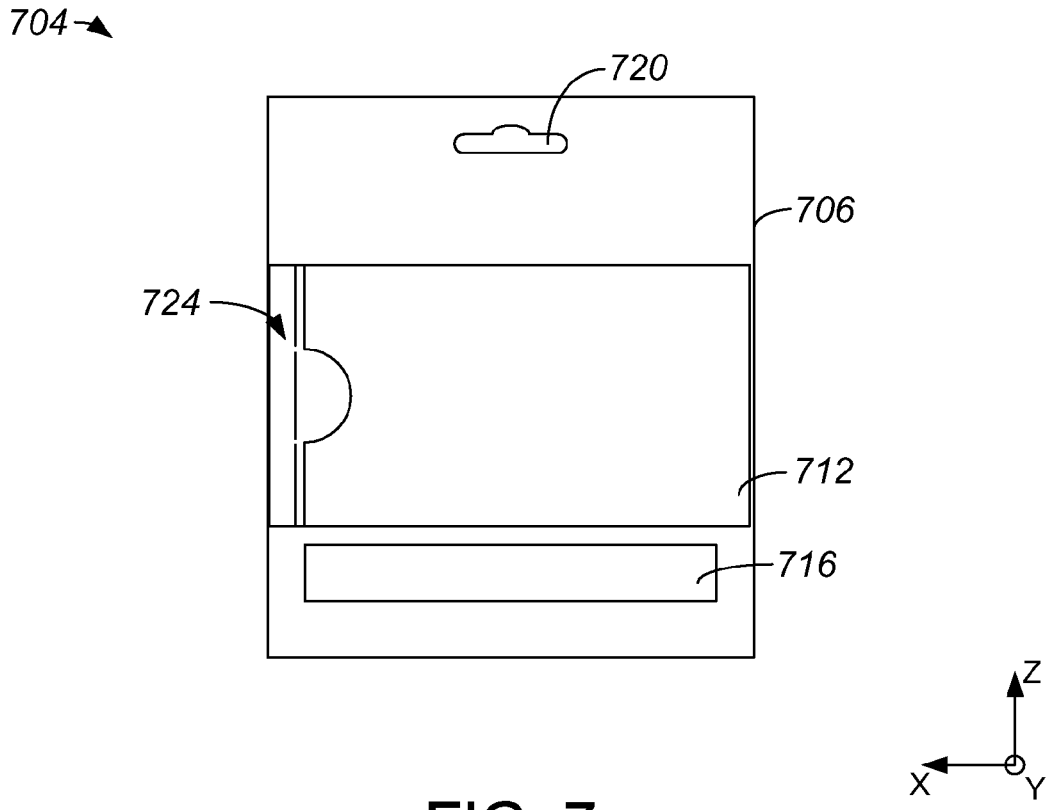
FIG. 7 is a diagrammatic back-view representation of a carrier card arrangement which includes an envelope that is attached to a side of a carrier card in accordance with an embodiment of the present invention.

A carrier card arrangement that includes a carrier card to which an envelope is integrally, but detachably, formed has been described above as including perforations on a long edge of the envelope. It should be appreciated that an envelope may instead be integrally formed to a carrier card such that perforations which allow the envelope to be detached from the carrier card are located on a short edge of the envelope. With reference to FIG. 7, a back-view of a carrier card arrangement which includes an envelope that is attached to a carrier card along a short edge of the envelope will be described in accordance with an embodiment of the present invention. A carrier card arrangement 704 includes a carrier card 706 and an envelope 712. Carrier card arrangement 704 also includes an opening 716 and an opening 720. Opening 716 enables a bar code or a magnetic stripe of a transaction card (not shown) mounted on a front of carrier card 706 to be viewed, while opening 720 enables carrier card arrangement 740 to be hung on a peg.

Envelope 712 is coupled to carrier card 706 at a perforated edge 724. Perforated edge 724 includes perforations arranged to enable envelope 712 to effectively be detached from, e.g., torn off of, carrier card 706. Perforated edge 724 is substantially parallel to a side edge of carrier card 706. While perforations in perforated edge 724 are shown as being relatively long, it should be appreciated that the perforations may instead be relatively short. More generally, perforations in perforated edge 724 may be of substantially any size.

An amount of adhesive, e.g., at least one spot or drop of adhesive, may be applied between a back surface of carrier card 706 and an opposing surface of envelope 712 to hold envelope against the back surface of carrier card 706. The back surface of carrier card 706, in one embodiment, is the opposite side from the side on which a transaction card (not shown) is mounted, and the opposing surface of envelope 712 is the surface of envelope which contacts the back surface of carrier card 706.

Although only a few embodiments of the present invention have been described, it should be understood that the present invention may be embodied in many other specific forms without departing from the spirit or the scope of the present invention. By way of example, an envelope has generally been described as being attached to a carrier card such that a long edge of the envelope is substantially parallel to a top edge of the carrier card. However, a long edge of an envelope may instead be substantially parallel to a side edge of the carrier card. In other words, the orientation of an envelope relative to a carrier card to which the envelope is attached may vary.

Additionally, the size of a carrier card may vary. In general, a carrier card has a width of at least approximately four inches and a height of at least approximately 5.25 inches. For instance, if a long edge of an envelope is substantially parallel to a side edge of a carrier card, then a carrier card may have a height that is larger than 5.25 inches such that the envelope does not obscure any openings in the carrier card. In some instances, a carrier card may also be smaller than approximately four inches and a height of less than approximately 5.25 inches.

Transaction cards are often monetary transaction cards. Monetary transaction cards generally include smart cards, credit cards, debit cards, automatic teller machine (ATM) cards, identification (ID) cards, and pre-paid cards such as gift cards. Typically, monetary transaction cards are of a standard credit card size, or the size of a CR-80 card. It should be appreciated, however, the transaction cards are not limited to being monetary transaction cards. In general, a transaction card may be any card that allows its holder to participate in a transaction whether the transaction includes monetary value or not.

In one embodiment, a card package may be placed in a case, e.g., a clamshell case, which is arranged to substantially contain the entire package. For instance, a card package may be placed in a case for protective and/or security purposes.

The use of adhesive at a number of predetermined locations on a carrier card arrangement has been described as allowing an envelope to be formed and substantially securing the envelope against a carrier card. Adhesive has also been described as being suitable for mounting or otherwise securing a transaction card to a surface of a carrier card. The adhesive used to substantially secure an envelope against a carrier card, and the adhesive used to mount a transaction card to the carrier card, may be a fugitive glue that is arranged to enable the envelope and the transaction card to be secured against the carrier card, but still be relatively easily removed.

The adhesive used to form the envelope, i.e., the adhesive used to glue the tabs of the envelope to the inside surfaces of the envelope, is generally relatively strong. Unlike the fugitive glue that allows the envelope and a transaction card to be removably held against a carrier card, the adhesive used to form the envelope is not generally intended to allow the envelope to be deconstructed. As such, the adhesive used to form the envelope is typically not the same as the adhesive that allows the envelope and a transaction card to be removably held against a carrier card.

In general, methods which do not include the use of adhesive may be used to form an envelope, secure the envelope against a carrier card, and/or secure a transaction card to the carrier card. For example, an envelope may be formed by tucking appropriate tabs into slits such that the envelope is effectively constructed without adhesive. Additionally, a transaction card may be secured to a carrier card by inserting the transaction card in slits or cuts that are made in the carrier card.

While one envelope has generally been described as being formed as a part of a carrier card arrangement, it should be appreciated that more than one envelope may be formed. More than one envelope may be formed as a part of a carrier card arrangement. By way of example, if more than one transaction card is to be included as part of a card package, then a carrier card arrangement may include more than one envelope such that each transaction card effectively has a corresponding envelope.

The operations associated with the various methods of the present invention may vary widely. By way of example, steps may be added, removed, altered, combined, and reordered without departing from the spirit or the scope of the present invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A carrier card arrangement, the carrier card arrangement being arranged to carry a transaction card, the carrier card arrangement comprising:

a carrier portion, the carrier portion including a first surface and a second surface, the first surface being on an opposite side of the carrier portion from the second surface, wherein the carrier portion further includes an edge; and an envelope portion, the envelope portion being integral with the edge of the carrier portion, the edge being at least partially defined by at least one perforation, wherein the envelope portion includes a third surface that at least partially abuts the second surface, the envelope having a housing sized to accommodate and store the transaction card when detached from the carrier portion, wherein the transaction card is mounted to the first surface of the carrier portion such that the transaction card is visible on the first surface of the carrier portion and the envelope is visible on the second surface of the carrier portion.

2. The carrier card arrangement of claim 1 wherein the envelope portion is arranged to be detached from the carrier portion at the at least one perforation.

3. The carrier card arrangement of claim 1 wherein the carrier card arrangement includes adhesive, the adhesive being arranged between the third surface and the second surface to secure the envelope portion against the carrier portion.

4. The carrier card arrangement of claim 1 wherein the carrier portion having has a first opening defined therein, the first opening being defined such that activation information associated with the transaction card is accessible through the first opening.

5. The carrier card arrangement of claim 1 further including an opening defined in the envelope portion, the opening being sized to enable the transaction card to be placed in the envelope.

6. The carrier card arrangement of claim 5 wherein the envelope portion includes a notch associated with opening.

7. The carrier card arrangement of claim 1 wherein the carrier portion and the envelope are formed from a single sheet of material.

8. The carrier card arrangement of claim 7 wherein the single sheet of material is a single sheet of paper stock.

9. A card package comprising:

a carrier card arrangement, the carrier card arrangement including a carrier card and an envelope, the carrier card having a front surface, the envelope and the carrier card being integrally formed and sharing an edge, wherein the edge includes at least one perforation to removably detach the envelope from the carrier card; and a transaction card, the transaction card being mounted at least partially on the front surface of the carrier card, wherein the envelope is removably attached to a rear surface of the carrier card and only visible when the carrier card arrangement is viewed from the rear surface, and wherein the envelope includes a housing sized to accommodate and store the transaction card.

10. The card package of claim 9 wherein the carrier card further includes a back surface and the envelope at least partially contacts the back surface.

11. The card package of claim 10 further including:

at least one adhesive element, the at least one adhesive element being arranged to secure the envelope against the back surface.

12. The card package of claim 9 wherein the transaction card includes an activation element and the carrier card includes a first opening, the activation element being accessible through the first opening.

13. The card package of claim 12 wherein the activation element is mounted on the front surface of the carrier card such that the activation element is positioned over the first opening.

14. The card package of claim 9 wherein the envelope is arranged to be detached from the carrier card through the at least one perforation.

15. The card package of claim 9 wherein the envelope is sized to accommodate the transaction card.

16. The card package of claim 15 wherein a first opening is defined in the envelope, the first opening being sized to enable the transaction card to be placed in the envelope.

17. The card package of claim 9 wherein the transaction card is a CR-80 transaction card.

18. The card package of claim 9 wherein the carrier card and the envelope are formed from a single sheet of material.

19. The card package of claim 18 wherein the single sheet of material is a single sheet of paper stock.

20. A method of forming a carrier card arrangement, the method comprising:

obtaining a single sheet of material;

defining a carrier card portion on the single sheet of material, the carrier card portion configured to removably mount a transaction card on a first surface using an adhesive element;

defining an envelope portion on the single sheet of material, wherein the carrier card portion and the envelope portion share a common perforated edge;

manipulating the single sheet of material to create a carrier card from the carrier card portion and to create an envelope from the envelope portion;

forming the envelope portion to include a housing sized to receive and store the transaction card; and folding and securing the formed envelope portion to a second surface of the carrier card portion such that the envelope portion is visible only when viewed from the second surface of the carrier card portion.

21. The method of claim 20 wherein the envelope is sized to accommodate a transaction card.

22. The method of claim 20 wherein manipulating the single sheet of material includes folding the single sheet of material.

23. The method of claim 22 wherein manipulating the single sheet of material further includes applying adhesive to create the envelope from the envelope portion.

* * * * *